US010627759B1

(12) United States Patent
Fukaya

(10) Patent No.: US 10,627,759 B1
(45) Date of Patent: Apr. 21, 2020

(54) IMAGE FORMING APPARATUS AND METHOD SELECTABLY DISPLAYING CANDIDATES OF CONSUMABLES BASED ON DESIGNATED CONSUMABLES

(71) Applicant: TOSHIBA TEC KABUSHIKI KAISHA, Shinagawa-ku, Tokyo (JP)

(72) Inventor: Hideaki Fukaya, Shimizu Sunto (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/164,901

(22) Filed: Oct. 19, 2018

(51) Int. Cl.
*G03G 15/00* (2006.01)

(52) U.S. Cl.
CPC ..... *G03G 15/5016* (2013.01); *G03G 15/502* (2013.01); *G03G 15/5029* (2013.01); *G03G 15/5066* (2013.01); *G03G 2215/00025* (2013.01); *G03G 2215/00489* (2013.01)

(58) Field of Classification Search
CPC ..... G03G 15/5016; G03G 15/502; G03G 15/5029; G03G 15/5066; G03G 2215/00025; G03G 2215/00489
See application file for complete search history.

(56) References Cited

U.S. PATENT DOCUMENTS

| | | | | |
|---|---|---|---|---|
| 8,401,411 | B2 | 3/2013 | Yamade | |
| 9,684,259 | B2 | 6/2017 | Komori et al. | |
| 9,955,046 | B1 * | 4/2018 | Sugiyama | G03G 15/502 |
| 2012/0019861 | A1 * | 1/2012 | Okada | G03G 15/5016 358/1.15 |
| 2017/0269517 | A1 * | 9/2017 | Ikeda | G03G 15/6585 |

* cited by examiner

*Primary Examiner* — Joseph S Wong
(74) *Attorney, Agent, or Firm* — Amin, Turocy & Watson, LLP

(57) ABSTRACT

An image forming apparatus includes an image forming unit, an input unit and a control unit. The image forming unit forms an image by using a plurality of consumables . The input unit receives an input of information designating the consumables to be used for forming the image. The control unit selectably displays other candidates of the consumables to be used for forming the image, based on the designated consumables.

18 Claims, 9 Drawing Sheets

FIG. 4

D100

| SHEET PROPERTY INFORMATION (SHEET COLOR INFORMATION) | TONER PROPERTY INFORMATION (TONER COLOR INFORMATION) | | | | |
|---|---|---|---|---|---|
| | BLACK TONER | WHITE TONER | GOLD TONER | BLUE DECOLORIZING TONER | RED DECOLORIZING TONER |
| WHITE PAPER | ○ | × | ○ | ○ | ○ |
| BLUE PAPER | ○ | ○ | ○ | × | ○ |
| YELLOW PAPER | ○ | ○ | × | ○ | ○ |
| RED PAPER | ○ | ○ | ○ | ○ | × |

FIG. 5

D101

| MAIN TONER | AUXILIARY BLACK TONER | AUXILIARY WHITE TONER | AUXILIARY GOLD TONER | AUXILIARY BLUE TONER | AUXILIARY RED TONER |
|---|---|---|---|---|---|
| BLACK COLOR | — | ○ | ○ | ○ | × |
| WHITE COLOR | ○ | — | ○ | ○ | × |
| GOLD COLOR | ○ | ○ | — | ○ | ○ |
| BLUE COLOR | ○ | ○ | ○ | ○ | ○ |
| RED COLOR | × | × | ○ | ○ | — |

IMAGE FORMING APPARATUS AND METHOD SELECTABLY DISPLAYING CANDIDATES OF CONSUMABLES BASED ON DESIGNATED CONSUMABLES

FIELD

Embodiments described herein relate generally to an Image forming apparatus and an image forming method.

BACKGROUND

There is an image forming apparatus which forms an image on a sheet by using a decolorizable toner or a toner of white color or gold color. In such an image forming apparatus, an image is formed on a sheet by a toner corresponding to a user's instruction. However, the color of such a toner may be similar to a color of a sheet on which an image is to be formed, and thus, visibility of the image may be poor in some cases. For example, when an image forming apparatus forms an image on a white sheet with a white toner, the visibility of the image is poor due to low contrast. Therefore, in consideration of factors like visibility, it is necessary for the user to instruct a combination of consumables, such as a toner and a sheet to be used to the image forming apparatus.

As described above, in an image forming apparatus in the related art, it is necessary for a user to consider a combination of consumables to be used, and the burden on the user is large in some cases.

DESCRIPTION OF THE DRAWINGS

FIG. 4 is a diagram illustrating a specific example of sheet combination information according to the embodiment;

FIG. 5 is a diagram illustrating a specific example of toner combination information according to the embodiment;

DETAILED DESCRIPTION

An image forming apparatus includes an image forming unit, an input unit and a control unit. The image forming unit forms images by using a plurality of consumables. The input unit receives an input of information designating the consumables used for forming the images. The control unit selectably displays other candidates of the consumables used for forming the images, based on the designated consumables.

(First Embodiment)

Figure 1:
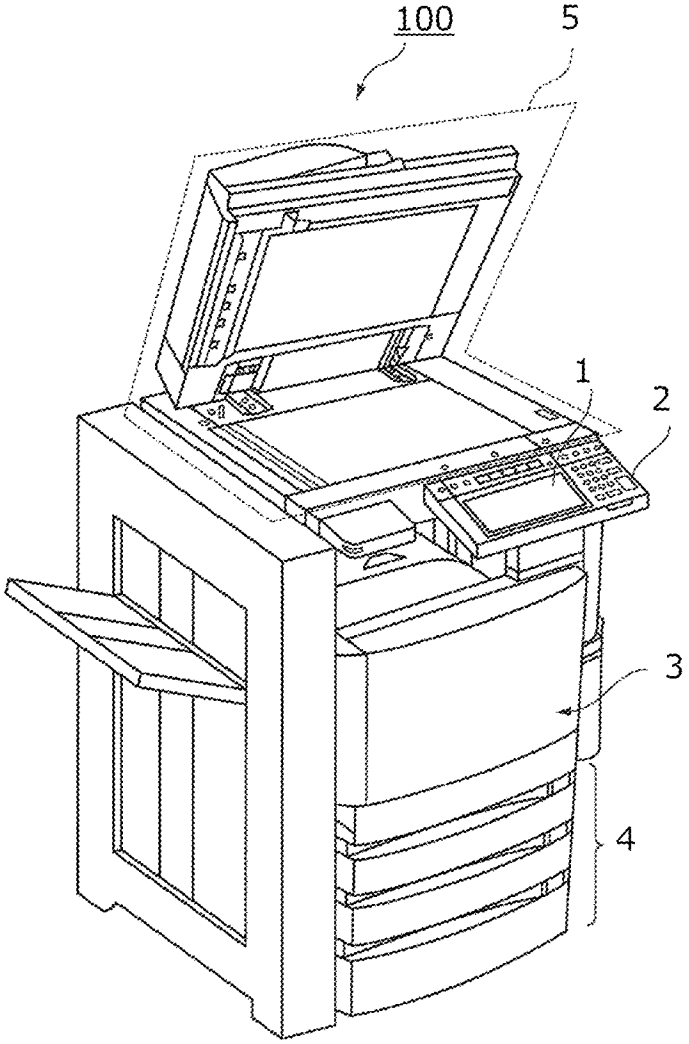
FIG. 1 is an external view of an overall configuration example of an image forming apparatus 100 according to an embodiment.

FIG. 1 is an external view of an overall configuration example of an image forming apparatus 100 according to an embodiment. The image forming apparatus 100 is, for example, a multifunctional printer.

The image forming apparatus 100 includes a display 1, a control panel 2, an image forming unit 3, a sheet accommodating unit 4 and an image reading unit 5. The image forming unit 3 of the image forming apparatus 100 may be an electro-photography type apparatus for fixing a toner image or an inkjet type apparatus.

The image forming apparatus 100 obtains image information and forms an image represented by the image information by using consumables, such as a developing agent and a sheet. Specifically, the image forming apparatus 100 obtains image information and forms an image represented by the obtained image information or designated image information on a sheet by using a developing agent for a single color or developing agents for a plurality of colors. The developing agent may be a toner or an ink. Hereinafter, for simplicity of explanation, the developing agent is assumed to be a toner. The toner may be a non-decolorizable toner of a primary color such as black color, a toner of white color or gold color, or a decolorizable toner (hereinafter referred to as "decolorizing toner"). Image information includes information indicating colors of the image represented by the image information (hereinafter referred to as "image color information").

The image forming apparatus 100 receives a selection or a designation of information indicating the property of a toner used for forming an image (hereinafter referred to as "toner property information"). By selecting toner property information, a user designates a toner indicated by the toner property information as a toner to be used for forming an image. The image forming apparatus 100 displays first display information according to toner properties indicated by the selected toner property information when the selected toner property information and the sheet property satisfy a predetermined condition. The first display information is information about a candidate sheet, which is a sheet corresponding to the toner property indicated by the selected toner property information and is suitable for forming an image. The toner property may be, for example, the color, the fixing temperature or the decolorizing temperature of a toner. In the present embodiment, the toner property is the color of a toner.

In addition, the image forming apparatus 100 displays second display information according to the selected toner property information. The second display information is information about a candidate toner that satisfies a predetermined condition as a toner having a property indicated by toner property information and is used for forming an image.

In addition, the image forming apparatus 100 receives a selection or a designation of information indicating the property of sheets used for forming an image and accommodated in a tray (hereinafter referred to as "sheet property information"). By selecting the sheet property information, the user designates a sheet indicated by the sheet property information and accommodated in the tray as a sheet to be used for forming an image. In addition, the image forming apparatus 100 displays third display information according to the selected sheet property information. The third display information is information about a candidate toner that satisfies a predetermined condition as a toner having a property indicated by sheet property information and is used for forming an image.

The image forming apparatus 100 can receive a selection or a designation of a plurality of pieces of toner property information for one piece of image information. For example, the image forming apparatus 100 can accept a selection of toner property information indicating red color and toner property information indicating black color.

The first display information may be any information as long as it is information about a candidate sheet, which is a sheet corresponding to the toner property indicated by the selected toner property information and is suitable for forming an image. The first display information may be, for example, information indicating a color of a candidate sheet suitable for forming an image or information indicating a tray that accommodates a candidate sheet suitable for forming an image.

The second display information may be any information as long as it is information about a candidate toner that satisfies a predetermined condition as a toner having a property indicated by toner property information and is used for forming an image. The second display information may be, for example, information indicating the color of a toner, the fixing temperature of the toner or the decolorizing temperature. In the present embodiment, the second display information indicates the color of a toner.

The third display information may be any information as long as it is information about a candidate toner that satisfies a predetermined condition for a sheet accommodated in the tray indicated by tray property information and is suitable for forming an image. The third display information may be, for example, information indicating the color of a toner, the fixing temperature of the toner or the decolorizing temperature. In the present embodiment, the third display information indicates the color of a toner.

The sheet is, for example, a paper or a label paper. The sheet may be anything as long as the image forming apparatus 100 can form an image on a surface thereof.

The display 1 is an image display device, such as a liquid crystal display and an organic electro luminescence (EL) display. The display 1 displays various types of information about the image forming apparatus 100. The display 1 displays the first display information, the second display information and the third display information as examples of various types of information. The first display information may be an icon indicating a tray that accommodates an image-formable sheet. The first display information may be a character indicating a tray that accommodates an image-formable sheet. The first display information may be an icon of a color of an image formable sheet. The property of a toner indicated by the second display information and the third display information (a color in the present embodiment) may be displayed on the display 1 in any way. The second display information and the third display information may be, for example, icons of a color indicated by the second display information and the third display information. The second display information and the third display information may be, for example, characters of a color indicated by the second display information and the third display information.

The control panel 2 includes a plurality of buttons. The control panel 2 receives a user's operation. The control panel 2 receives selections of the toner property information and the sheet property information and an input of an image forming instruction through a user's operation. The image forming instruction is an instruction for the image forming apparatus 100 to execute formation of an image. The control panel 2 outputs a signal corresponding to an operation performed by the user to the control unit of the image forming apparatus 100. The display 1 and the control panel 2 may be configured as an integral touch panel.

The image forming unit 3 forms an image on a sheet based on image information generated by the image reading unit 5 or image information received via a communication path. The image forming unit 3 forms an image, for example, by a process as described below. The image forming unit 3 forms an electrostatic latent image on a photoconductive drum based on the image information. The image forming unit 3 forms a visible image by attaching a developing agent to the electrostatic latent image. A specific example of the developing agent is a toner. A transfer unit of the image forming unit 3 transfers the visible image onto a sheet. A fixing unit of the image forming unit 3 fixes the visible image on the sheet by applying heat and pressure to the sheet. The sheet on which the image is formed may be a sheet accommodated in the sheet accommodating unit 4 or may be a sheet fed manually.

The sheet accommodating unit 4 accommodates sheets used for forming images in the image forming unit 3.

The image reading unit 5 reads image information of a target to be read, as contrast of light. The image reading unit 5 records the read image information. The recorded image information may be transmitted to another information processing apparatus via a network. The recorded image information may be formed on a sheet as an image by the image forming unit 3.

Figure 2:
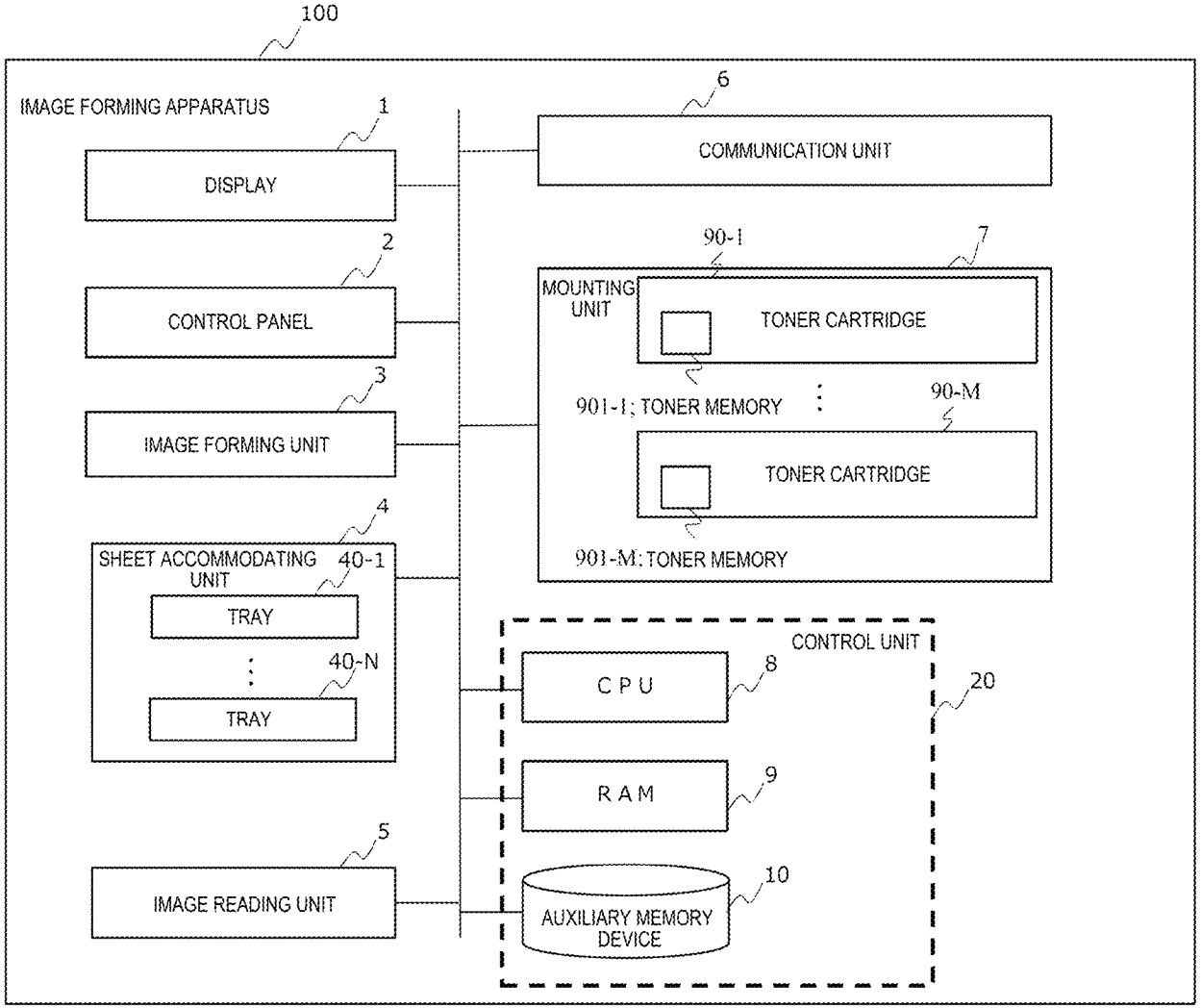
FIG. 2 is a diagram illustrating a specific example of a hardware configuration of the image forming apparatus 100 according to the embodiment.

FIG. 2 is a diagram illustrating a specific example of the hardware configuration of the image forming apparatus 100 according to the embodiment.

The image forming apparatus 100 includes a central processing unit (CPU) 8, a random access memory (RAM) 9, an auxiliary memory device 10, and the like connected via a bus, and executes a program. The image forming apparatus 100 functions as an apparatus including the display 1, the control panel 2, the image forming unit 3, the sheet accommodating unit 4, the image reading unit 5, a communication unit 6 and a mounting unit 7 as a program is executed.

Figure 3:
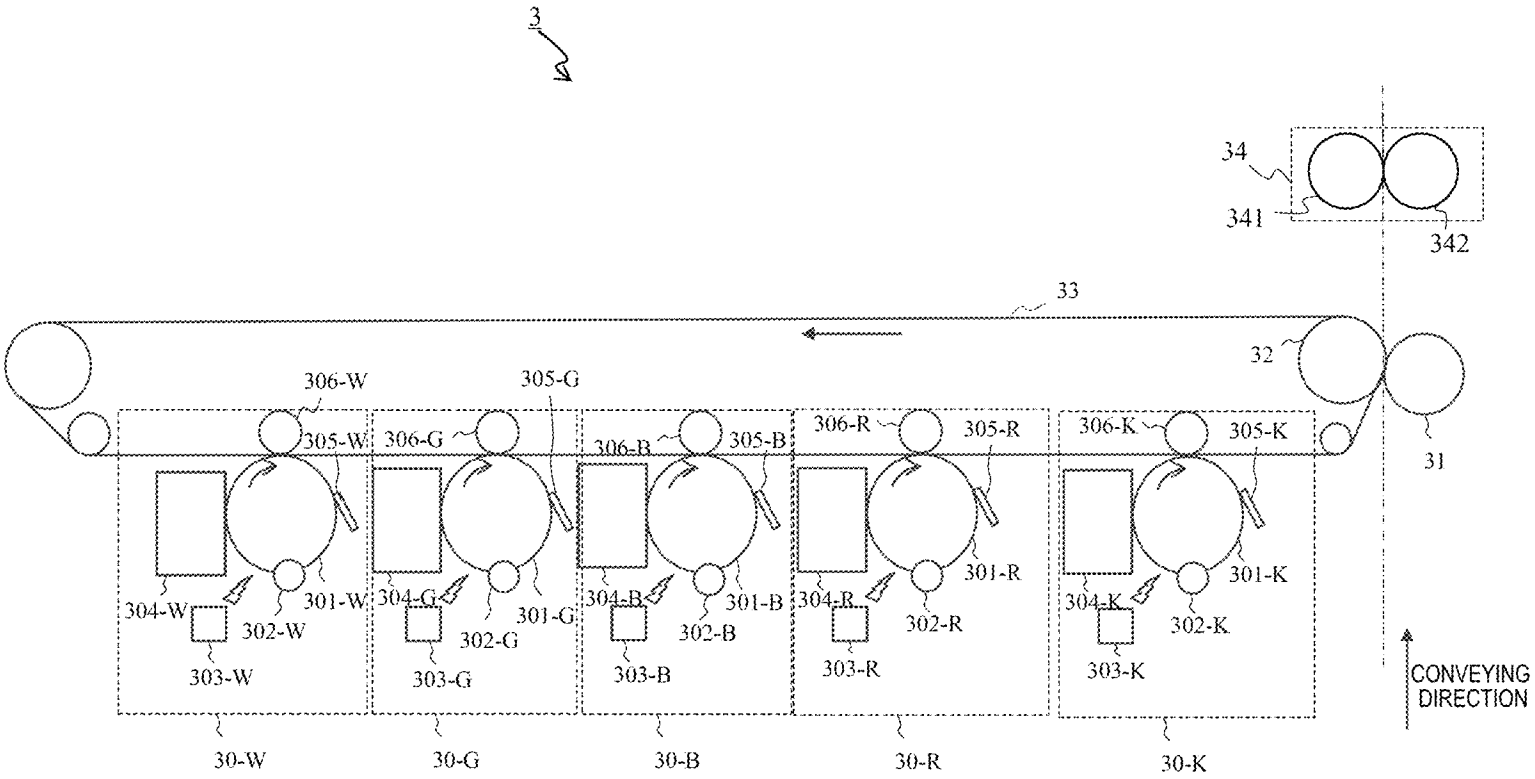
FIG. 3 is a cross-sectional view illustrating a configuration example of an image forming unit 3 according to the embodiment.

FIG. 3 is a cross-sectional view illustrating a configuration example of the image forming unit 3 according to the embodiment.

FIG. 3 illustrates a configuration example of the image forming unit 3 for forming an image with five types of toners including a black toner, a white toner, a gold toner, a blue decolorizing toner and a red decolorizing toner. The image formation unit 3 does not necessarily form images with five types of toners. The image forming unit 3 may form an image with six or more types of toners or may form an image with less than five types of toners. Furthermore, the image forming unit 3 may form an image with toners other than the five types of toners by exchanging a toner cartridge described later. The toners other than the five types of toners may be, for example, a yellow toner, a magenta toner and a cyan toner. Hereinafter, for simplicity of explanation, the image forming unit 3 is assumed to form an image with five types of toners of a black toner, a white toner, a gold toner, a blue decolorizing toner and a red decolorizing toner.

The image forming unit 3 includes a process unit 30-W, a process unit 30-G, a process unit 30-B, a process unit 30-R, a process unit 30-K, a secondary transfer roller 31, a secondary transfer counter roller 32, an intermediate transfer belt 33 and a fixing unit 34.

The process unit 30-W forms a toner image on the intermediate transfer belt 33, which is an endless belt with a white toner. The process unit 30-G forms a toner image on the intermediate transfer belt 33, which is an endless belt, with a gold toner. The process unit 30-B forms a toner image on the intermediate transfer belt 33, which is an endless belt, with a blue decolorizing toner. The process unit 30-R forms a toner image on the intermediate transfer belt 33, which is an endless belt, with a red decolorizing toner. The process unit 30-K forms a toner image on the intermediate transfer belt 33, which is an endless belt, with a black toner.

Hereinafter, the process units 30-W, 30-G, 30-B, 30-R and 30-K will be referred to as a process unit 30 unless distinction is made therebetween.

The process unit 30 forms a toner image on the intermediate transfer belt 33, which is an endless belt. The process unit 30 includes a photoconductive drum 301, a charger 302, an exposure device 303, a developing device 304, a photoconductor cleaner 305 and a primary transfer roller 306. In FIG. 3, the functional units of the process unit 30 corresponding to the respective toners of the white toner, the gold toner, the blue decolorizing toner, the red decolorizing toner and the black toner are distinguished by the signs of W, G, B, R and K as those of the process unit 30. For example, 301-W represents the photoconductive drum 301 provided in the process unit 30-W.

The photoconductive drum 301 generates an electrostatic latent image on a surface thereof. The photoconductive drum 301 is an image holding member and is, for example, a cylindrical drum. The photoconductive drum 301 includes a photoconductive material on outer peripheral surface thereof.

The charger 302 charges the surface of the photoconductive drum 301 with static electricity. The charger 302 may be any types of devices as long as it is capable of charging the photoconductive drum 301 (a corona discharge wire, a roller, a blade, a needle electrode or the like). The charger 302 is, for example, a needle electrode.

The exposure device 303 forms an electrostatic latent image of an image of a target to be formed on the surface of the photoconductive drum 301 by irradiating light to the photoconductive drum 301 charged on the surface thereon. The exposure device 303 may be any type of device (a laser scanning device, an LED line head or the like) as long as it is capable of forming an electrostatic latent image of an image of a target to be formed on the surface of the photoconductive drum 301 by irradiating light. The exposure device 303 is, for example, a laser irradiating device.

The developing device 304 supplies a toner to the surface of the photoconductive drum 301 and develops the electrostatic latent image with the toner.

The photoconductor cleaner 305 removes the toner remaining on the photoconductive drum 301. The removed toner is collected in a waste toner tank (not illustrated) and discarded.

The primary transfer roller 306 transfers the electrostatic latent image developed on the surface of the photoconductive drum 301 (that is, a toner image) onto the intermediate transfer belt 33.

The secondary transfer roller 31 transfers the toner image on the intermediate transfer belt 33 onto a sheet. The secondary transfer counter roller 32 is located at a position facing the secondary transfer roller 31 across the intermediate transfer belt 33. The secondary transfer counter roller 32 sandwiches the sheet against the secondary transfer roller 31 and conveys the sheet having the toner image transferred thereto to the fixing unit 34.

The fixing unit 34 includes a heat roller 341 and a press roller 342. The heat roller 341 heats the sheet. The press roller 342 presses the sheet against the heat roller 341. The fixing unit 34 fixes the toner image to the conveyed sheet with the heat applied by the heat roller 341 and the pressure applied by the press roller 342. The sheet having the toner image transferred thereto is conveyed out of the image forming unit 3 by the heat roller 341 and the press roller 342.

Referring back to FIG. 2, the sheet accommodating unit 4 includes a plurality of trays 40-1 to 40-N (N is a positive integer). Hereinafter, the trays 40-1 to 40-N will be referred to as a tray 40 unless distinction is made therebetween. The tray 40 accommodates sheets. The sheet accommodating unit 4 obtains information indicating the number or the quantity of sheets accommodated in each tray 40 (hereinafter referred to as "sheet number information") at a predetermined timing. The sheet accommodating unit 4 may acquire sheet number information in any way. For example, the sheet accommodating unit 4 may acquire sheet number information by providing a weighing scale, which is not illustrated for each tray 40 and measuring the weight of sheets accommodated in each tray 40. The sheet accommodating unit 4 may include, for example, an optical sensor, which is not illustrated. In this case, the sheet accommodating unit 4 may acquire sheet number information by detecting the position of the uppermost sheet of sheets or the position of a sheet stacking surface through the optical sensor and converting the detected position into the sheet number information. The sheet accommodating unit 4 outputs the obtained sheet number information.

The communication unit 6 is configured to include a communication interface for communicably connecting the image forming apparatus 100 to an external apparatus. The communication unit 6 communicates with the external apparatus via a communication line.

The mounting unit 7 accommodates toner cartridges 90-1 to 90-M (M is a positive integer) in an exchangeable manner. Hereinafter, the toner cartridges 90-1 to 90-M are referred to as a toner cartridge 90 unless distinction is made therebetween. The toner cartridge 90 supplies a toner used by the image forming unit 3 for forming an image. The mounting unit 7 electrically connects the toner cartridge 90 accommodated therein to the image forming apparatus 100.

The toner cartridge 90 includes a toner memory 901. The toner memory 901 is configured by using a storage device, such as a semiconductor memory device. The toner memory 901 may be, for example, an integrated circuit (IC) chip. The toner memory 901 stores information indicating the property of a toner supplied by the toner cartridge 90 having own memory (hereinafter referred to as "memory-stored toner property information"). The memory-stored toner property information indicates the color of a toner in the present embodiment.

The property of a toner that can be selected or designated by a user via the control panel 2 is the property of the toner stored in each toner memory 901. For example, if the properties of toners indicated by the memory-stored toner property information are black color, white color, gold color, blue color and red color, the user can select or designate any of black color, white color, gold color, blue color and red color. The fact that a color can be selected refers to that the color of a toner is designated to the image forming apparatus 100 at the time of forming an image.

The CPU 8 (processor) functions as the control unit 20 by executing programs stored in the RAM 9 and the auxiliary memory device 10. The control unit 20 controls the operation of each functional unit of the image forming apparatus 100.

The auxiliary memory device 10 is configured by using a storage device, such as a magnetic hard disk device or a semiconductor storage device. The auxiliary memory device 10 stores display screen information, sheet property information, sheet combination information, toner combination information, input-completed toner property information and input-completed sheet property information. The display screen information is information about a screen displayed on the display 1. The display screen information includes information about a screen displaying the first display information, information about a screen displaying the second display information, and information about a screen displaying the third display information. The sheet property information is information stored in the auxiliary memory device 10 in advance and indicates properties of a sheet accommodated in each tray 40, such as color and size. In the present embodiment, the sheet property information is information indicating the color. The sheet property information can be registered or changed by a user via the control panel 2 corresponding to sheets accommodated in the tray 40.

The input-completed toner property information indicates toner property information selected or designated by the user. The input-completed sheet property information is a value indicating sheet property information selected or designated by the user. The input-completed sheet property information has a value indicating that there is no selected or designated sheet property information when there is no sheet property information selected or designated by the user.

Hereinafter, for simplicity of explanation, when there is no sheet property information selected or designated by the user, it is said that the input-completed sheet property information indicates NO. Hereinafter, for simplicity of explanation, when there is sheet property information selected or designated by the user, it is said that the input-completed sheet property information indicates YES.

The sheet combination information is information stored in the auxiliary memory device 10 in advance. The sheet combination information indicates a combination of a toner and a sheet that satisfies a predetermined condition (hereinafter referred to as "sheet combination conditions") for good visibility. The sheet combination condition may be any condition as long as it is a condition for good visibility. The sheet combination condition may be, for example, a condition that the color difference between the color of a toner and the color of a sheet is a predetermined value or larger. The sheet combination condition may be, for example, a condition that the color difference between the color of a toner and the color of a sheet is within a predetermined range. Hereinafter, for simplicity of explanation, the sheet combination condition is assumed to be a condition that the color difference between the color of a toner and the color of a sheet is a predetermined value or larger.

FIG. 4 is a diagram illustrating a specific example of sheet combination information according to the embodiment.

For example, the sheet combination information is stored in the auxiliary memory device 10 as a sheet combination information table D100 illustrated in FIG. 4. The sheet combination information table D100 stores a value of the item "sheet property information (sheet color information)", a value of the item "black toner", a value of the item "white toner", a value of the item of "gold toner", a value of the item "blue decolorizing toner", and a value of the item "red decolorizing toner".

The item "sheet property information (sheet color information)" represents the color of a sheet. In FIG. 4, the item "sheet property information (sheet color information)" has values representing "white paper", "blue paper", "yellow paper" and "red paper". "White paper" represents a sheet of white color. "Blue paper" represents a sheet of blue color. "Yellow paper" represents a yellow sheet. "Red paper" represents a sheet of red color.

The item "black toner" represents formation of an image with a black toner. The item "white toner" represents formation of an image with a white toner. The item "gold toner" represents formation of an image with a gold toner. The item "blue decolorizing toner" represents formation of an image with a blue decolorizing toner. The item "red decolorizing toner" represents formation of an image with a red decolorizing toner. A decolorizing toner is a decolorizable toner.

The sheet combination information table D100 has values representing "○" or "X" based on combinations of the item "sheet property information (sheet color information)" with the items "black toner", "white toner", "gold toner", "blue decolorizing toner" and "red decolorizing toner". "○" indicates that a predetermined condition for good visibility is satisfied when an image is formed with a toner of a predetermined color on a sheet of a predetermined color. "X" indicates that a predetermined condition for good visibility is not satisfied when an image is formed with a toner of a predetermined color on a sheet of a predetermined color.

The sheet combination information table D100 indicates that, for example, when an image is formed with a white toner on a yellow sheet, the sheet combination condition is satisfied. The sheet combination information table D100 indicates that, for example, when an image is formed with a gold toner on a yellow sheet, the sheet combination condition is not satisfied.

The toner combination information is information stored in the auxiliary memory device 10 in advance. The toner combination information is information to show whether a combination of a plurality of toners satisfies a predetermined condition (hereinafter referred to as "toner combination condition") based on properties of various toners. The toner combination condition may be any condition as long as it is a condition based on the properties of various toners. The toner combination condition may be, for example, a condition that a plurality of toners can be fixed simultaneously. The fact that a plurality of toners can be fixed simultaneously indicates that the plurality of toners can be fixed without decolorization at the same temperature. In such a case, a combination that does not satisfy the toner combination condition is, for example, as illustrated in FIG. 5, a combination of fixation of a black toner and a fixation of a red decolorizing toner that decolorizes at the temperature at which the block toner is fixed. In other words, whether the toner combination condition is satisfied depends on whether fixation and/or decolorization of two or more types of toners can be simultaneously performed as intended.

Hereinafter, for simplicity of explanation, the toner combination condition is assumed to be a condition that a certain toner and another toner can be fixed simultaneously. In other words, the toner combination information assumed in the descriptions below indicates a combination of a certain toner and another toner that is not decolorized at the fixing temperature of the certain toner. When an image is formed with the combination of toners indicated by such toner combination information, the image forming apparatus 100 exhibits the effect below. The effect is that the possibility of forming a partially decolorized image can be reduced.

FIG. 5 is a diagram illustrating a specific example of toner combination information according to the embodiment.

For example, the toner combination information is stored in the auxiliary memory device 10 as a toner combination information table D101 illustrated in FIG. 5. The toner combination information table D101 stores a value of the item "main toner", a value of the item "auxiliary black toner", a value of the item "auxiliary white toner", a value of the item "auxiliary gold toner", a value of the item "auxiliary blue toner", and a value of the item "auxiliary red toner". The item "main toner" represents one toner in a toner combination. The item "main toner" has a value of the item "black color", a value of the item "white color", a value of the item "gold color", a value of the item "blue color" and a value of the item "red color". The item "black color" represents a black toner. The item "white color" represents a white toner. The item "gold color" represents a gold toner. The item "blue color" represents a blue decolorizing toner. The item "red color" represents a red decolorizing toner.

In FIG. 5, the item "auxiliary black toner" indicates that the other toner in the toner combination is a black toner. The item "auxiliary white toner" indicates that the other toner in the toner combination is a white toner. The item "auxiliary gold toner" indicates that the other toner in the toner combination is a gold toner. The item "auxiliary blue toner" indicates that the other toner in the toner combination is a blue decolorizing toner. The item "auxiliary red toner" indicates that the other toner in the toner combination is a red decolorizing toner.

The toner combination information table D101 has values representing "○" or "X" based on combinations of the item "main toner" with the items "auxiliary black toner", "auxiliary white toner", "auxiliary gold toner", "auxiliary blue toner" and "auxiliary red toner". "○" indicates that the toner combination information is satisfied. "X" indicates that the toner combination information is not satisfied. In addition, in FIG. 5, "-" indicates that there is no value and it does not indicate whether the toner combination condition is satisfied.

The toner combination information table D101 indicates that, for example, when the one toner of the toner combination is a white toner, the other toner that satisfies the toner combination condition is a black toner, a gold toner and a blue color decolorizing toner.

The control unit 20 obtains the toner property information, the sheet property information and the image forming instruction through the control panel 2. In addition, the control unit 20 executes an image forming instruction input determination, an image information obtainment, a memory information obtainment, a display control, a determination process and a sheet presence determination.

The control unit 20 determines whether an image forming instruction is inputted by executing the image forming instruction input determination. When it is determined, by executing the image forming instruction input determination, that an image forming instruction is inputted, the control unit 20 executes formation of the image indicated by image information.

The image information obtainment is a process that the control unit 20 obtains image information generated by the image reading unit 5 or image information received through the communication path. The memory information obtainment is a process that the control unit 20 obtains memory-stored toner property information stored in the toner memory 901.

The display control is a process that the control unit 20 obtains display screen information in response to an input through the control panel 2, and the control unit 20 displays the screen indicated by the display screen information on the display 1. By executing the display control by the control unit 20, the first display information, the second display information and the third display information are displayed on the display 1.

The determination includes an information determination, an input-completed sheet information determination, a first determination, a second determination and a third determination. When the toner property information or the sheet property information is obtained, the control unit 20 executes the information determination. By executing the information determination, the control unit 20 determines whether the information obtained by the control unit 20 is either the toner property information or the sheet property information. By executing the input-completed sheet information determination, the control unit 20 determines whether the input-completed sheet property information indicates NO or whether the input-completed sheet property information indicates YES.

When the control unit 20 determines that obtained information is toner property information and the input-completed sheet property information indicates NO, the control unit 20 executes the first determination.

The first determination includes a sheet determination and a toner determination. The control unit 20 determines a suitable sheet based on the input-completed toner property information, the toner combination information and the sheet combination information by executing the sheet determination in the first determination. The suitable sheet is a sheet that satisfies a sheet combination condition for all of toners including a toner having a property indicated by the input-completed toner property information and a toner having a property indicated by the toner combination information.

The control unit 20 determines a first suitable toner based on the input-completed toner property information and the toner combination information by executing the toner determination. The first suitable toner is a toner that satisfies a toner combination condition for all of toners including a toner having a property indicated by the input-completed toner property information and a toner having a property indicated by the toner property information.

After executing the first determination, the control unit 20 records the obtained toner property information in the auxiliary memory device 10 as input-completed toner property information.

When the control unit 20 determines that the obtained information is toner property information and the input-completed toner property information indicates YES, the control unit 20 executes the second determination.

The control unit 20 determines a second suitable toner based on the input-completed sheet property information, the in-tray accommodated sheet information, input-completed toner property information, the toner property information and the toner combination information by executing the second determination. The second suitable toner is a toner that further satisfies the sheet combination condition with respect to a sheet accommodated in the tray 40 indicated by the input-completed sheet property information among the first suitable toners.

After executing the second determination, the control unit 20 records the obtained toner property information in the auxiliary memory device 10 as input-completed toner property information.

When it is determined that the obtained information is sheet property information, the control unit 20 executes the third determination. The control unit 20 determines a third suitable toner based on the sheet property information, the in-tray accommodated sheet information, the input-completed toner property information and the toner combination information by executing the third determination. The third suitable toner is a toner that satisfies the sheet combination condition for the sheet accommodated in the tray 40 indicated by the tray property information and satisfies the toner combination condition for all of toners having the property indicated by the input-completed toner property information.

After executing the third determination, the control unit 20 records the input toner property information in the auxiliary memory device 10 as input-completed toner property information. After executing the third determination, the control unit 20 records the input sheet property information in the auxiliary memory device 10 as input-completed sheet property information.

The sheet presence determination is a process for, when sheet property information is input, determining whether a sheet is accommodated in the tray 40 indicated by the sheet property information based on the sheet number information and the in-tray accommodated sheet information. The sheet presence determination is a process that, when a suitable sheet is determined by execution of the determination, the control unit 20 determines whether a sheet is accommodated in the tray 40 for accommodating the suitable sheet.

Figure 6:
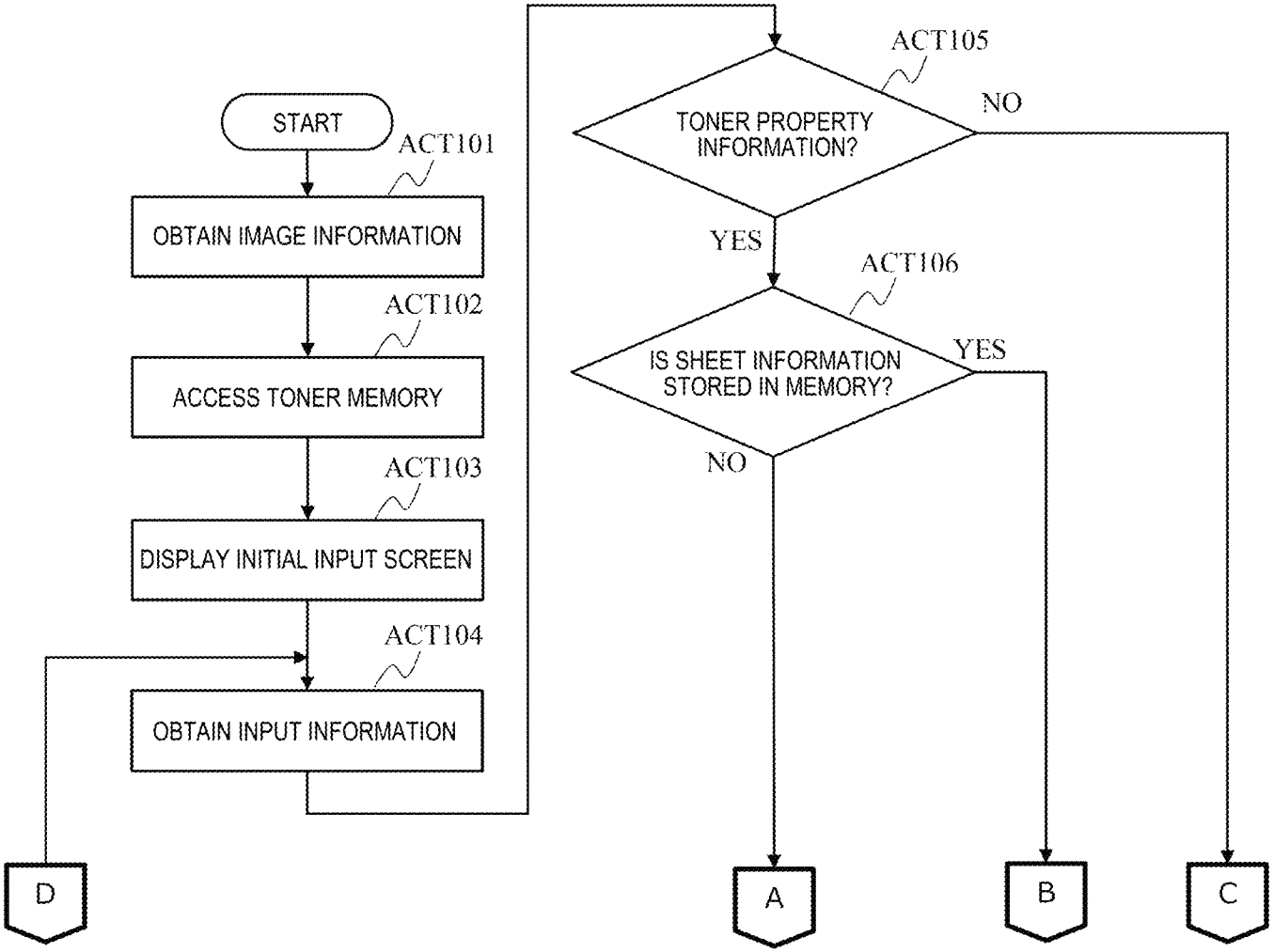
FIG. 6 is a first flowchart illustrating the flow of a specific process in which the image forming apparatus 100 according to the embodiment forms an image.
Figure 7:
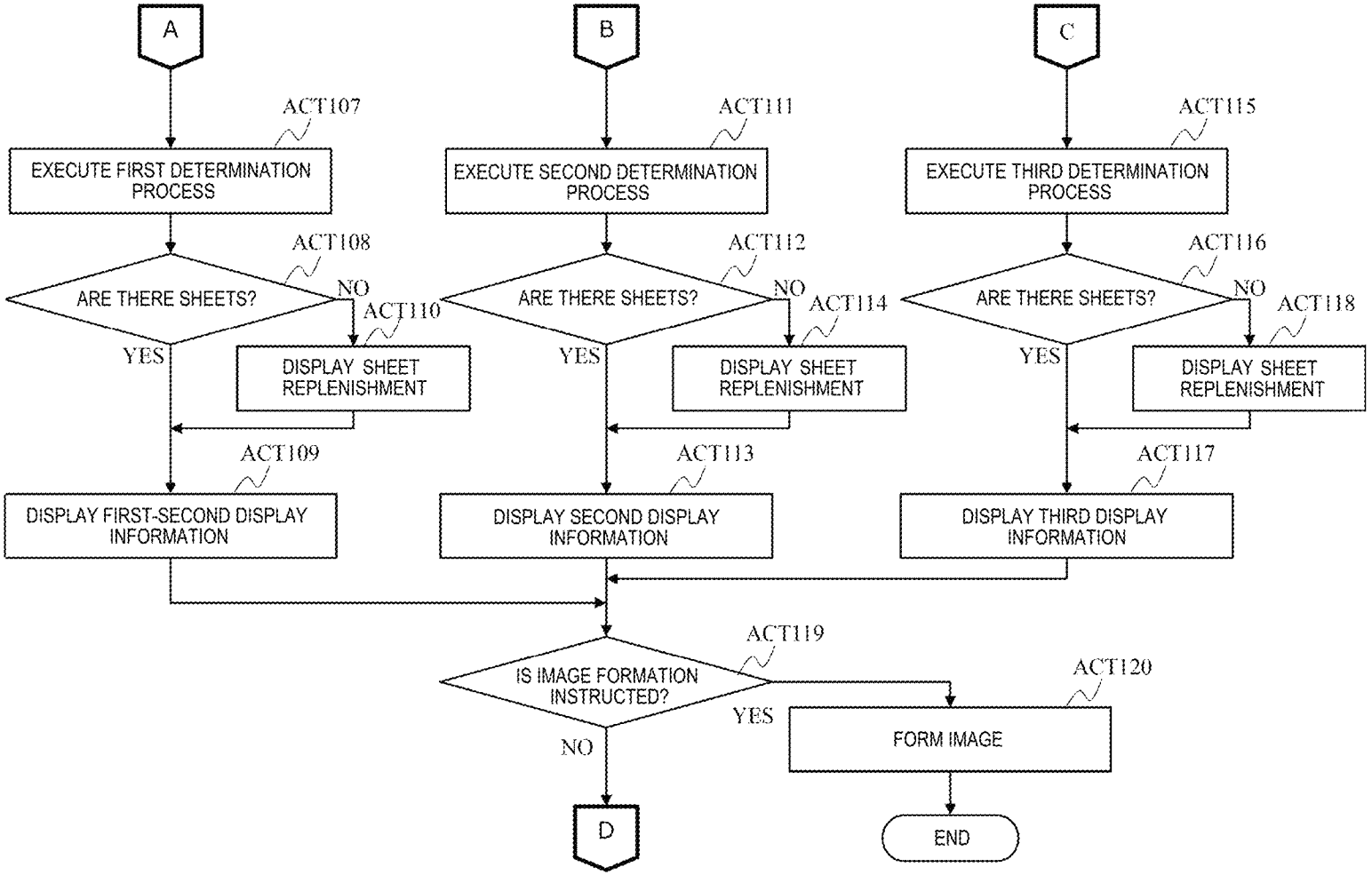
FIG. 7 is a second flowchart illustrating the flow of a specific process in which the image forming apparatus 100 according to the embodiment forms an image.

FIGS. 6 and 7 are flowcharts indicating the flows of specific processes in which the image forming apparatus 100 according to the embodiment forms an image.

The control unit 20 obtains image information generated by the image reading unit 5 or image information received via a communication path by executing the image information obtainment (ACT 101). By executing the memory information obtaining, the control unit 20 accesses all the toner memories 901 and obtains memory-stored toner property information (ACT 102). The control unit 20 displays a screen prompting input of toner property information or sheet property information (hereinafter referred to as "initial input screen") on the display 1 by executing the display control (ACT 103). The initial input screen is a screen that selectably displays colors of toners indicated by the memory-stored toner property information.

The control unit 20 obtains toner property information or sheet property information from a user via the control panel 2 (ACT 104). In FIG. 6, "obtain input information" refers to obtaining of toner property information or sheet property information. By executing the information determination, the control unit 20 determines whether the input information is toner property information or sheet property information (ACT 105). When the input information is toner property information (ACT 105: YES), the control unit 20 executes the input-completed sheet information determination (ACT 106). In FIG. 6, the process of ACT 106 is illustrated as "is sheet information stored in memory?".

When the input-completed sheet property information indicates NO (ACT 106: NO), the control unit 20 executes the first determination. The control unit 20 determines a suitable sheet by executing the sheet determination. Furthermore, the control unit 20 determines the first suitable toner by executing the toner determination (ACT 107). Next, the control unit 20 determines whether a suitable sheet is accommodated in the tray 40 based on the sheet number information and the in-tray accommodated sheet information by executing the sheet presence determination (ACT 108). When the suitable sheet is accommodated in the tray 40 (ACT 108: YES), the control unit 20 displays the first display information and the second display information on the display 1 by executing the display control (ACT 109). The first display information displayed in ACT 109 is information indicating the suitable sheet determined in ACT 107. The second display information displayed in ACT 109 is information indicating the first suitable toner determined in ACT 107. In FIG. 7, the process of ACT 109 is illustrated as "display first-second display information".

In ACT 108, if the suitable sheet is not accommodated in the tray 40 (ACT 108: NO), the control unit 20 controls the display 1 to display a screen prompting to replenish the suitable sheet by executing the display control (ACT 110). ACT 109 is executed after ACT 110. If the suitable sheet is not accommodated in the tray 40 (ACT 110: NO), ACT 109 and ACT 110 may be executed simultaneously. In this case, the display 1 displays a screen prompting to replenish the suitable sheet, the first display information and the second display information simultaneously.

If the input-completed sheet property information indicates YES (ACT 106: YES), the control unit 20 executes the second determination. The control unit 20 determines the second suitable toner by executing the second determination (ACT 111). Next, the control unit 20 determines whether the sheet indicated by the input-completed sheet property information is accommodated in the tray 40 based on the sheet number information and the in-tray accommodated sheet information by executing the sheet presence determination (ACT 112). When the sheet indicated by the input-completed sheet property information is accommodated in the tray 40 (ACT 112: YES), the control unit 20 displays the second display information on the display 1 by executing the display control (ACT 113). The second display information displayed in ACT 113 is information indicating the second suitable toner determined in ACT 111. In FIG. 7, the process of ACT 113 is illustrated as "display second display information". The sheet indicated by the input-completed sheet property information refers to a sheet accommodated in the tray 40 indicated by the input-completed sheet property information.

In ACT 112, if the sheet indicated by the input-completed sheet property information is not accommodated in the tray 40 (ACT 112: NO), the control unit 20 controls the display 1 to display a screen prompting to replenish the sheet indicated by the input-completed sheet property information by executing the display control (ACT 114). ACT 113 is executed after ACT 114. If the sheet indicated by the input-completed sheet property information is not accommodated in the tray 40 (ACT 112: NO), ACT 113 and ACT 114 may be executed simultaneously. In this case, the display 1 displays a screen prompting to replenish the suitable sheet and the second display information simultaneously.

In ACT 105, if the input information is sheet property information (ACT 105: NO), the control unit 20 executes the third determination. The control unit 20 determines the third suitable toner by executing the third determination (ACT 115). Next, the control unit 20 determines whether a sheet indicated by the sheet property information is accommodated in the tray 40 based on the sheet number information and the in-tray accommodated sheet information by executing the sheet presence determination (ACT 116). When the sheet is accommodated in the tray 40 (ACT 116: YES), the control unit 20 displays the third display information on the display 1 by executing the display control (ACT 117). The third display information displayed in ACT 117 is information indicating the third suitable toner determined in ACT 115.

In ACT 116, if the sheet is not accommodated in the tray 40 (ACT 116: NO), the control unit 20 controls the display 1 to display a screen prompting to replenish the sheet by executing the display control (ACT 118). ACT 117 is executed after ACT 118. If the sheet is not accommodated in the tray (ACT 116: NO), ACT 117 and ACT 118 may be executed simultaneously. In this case, the display 1 displays a screen prompting to replenish the sheet and the third display information simultaneously.

After ACT 109, ACT 113 and ACT 117, the control unit 20 executes the image forming instruction input determination. The control unit 20 determines whether an image forming instruction is inputted via the control panel 2 by executing the image forming instruction input determination (ACT 119). When an image forming instruction is not inputted (ACT 119: NO), the process returns to ACT 104. On the other hand, when an image forming instruction is inputted (ACT 119: YES), an image indicated by the image information obtained in ACT 101 is formed (ACT 120). The image formed in ACT 120 is formed by a toner indicated by the toner property information input in the processes ACT 101 to ACT 117. The sheet on which the image is to be formed in ACT 120 is a sheet stored in the tray 40 indicated by the tray property information input in the processes ACT 101 to ACT 117.

If a plurality of pieces of toner property information are input in the processes ACT 101 to ACT 117, the image forming apparatus 100 may form an image with toners indicated by the plurality of pieces of toner property information in any way. For example, the image forming apparatus 100 forms an image with toners indicated by the plurality of pieces of toner property information as follows. For example, the image forming apparatus 100 forms an image of each pixel indicated by the image information with a toner corresponding to the brightness value of the corresponding pixel among the toners indicated by the plurality of pieces of toner property information. More specifically, for example, when two pieces of toner property information are input, the image forming apparatus 100 forms images of pixels having brightness values higher than a predetermined value with one toner. In such a case, the image forming apparatus 100 forms images of pixels having brightness values less than or equal to the predetermined value with the other toner.

Figure 8:
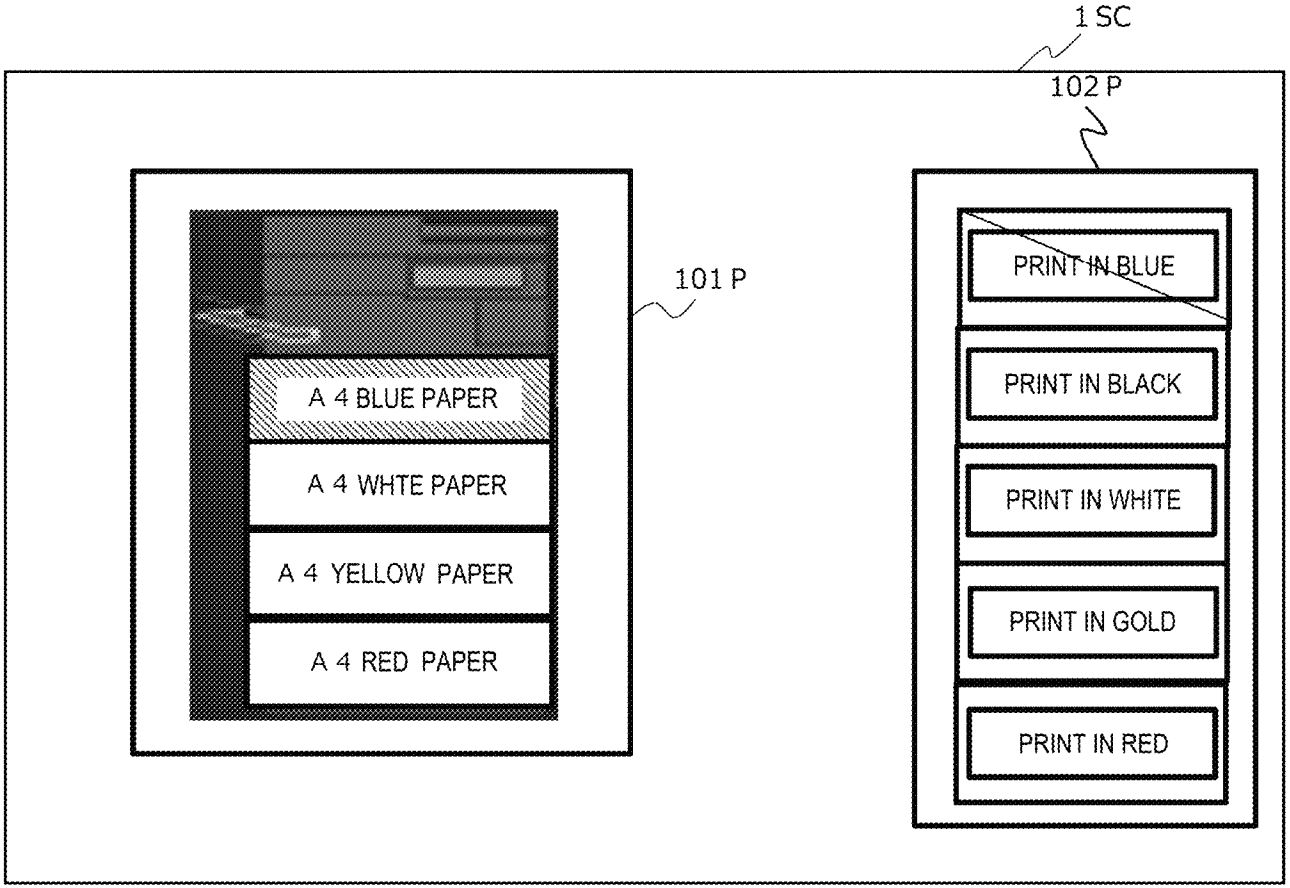
FIG. 8 is a diagram illustrating a specific example of a screen displayed on a display 1 according to the embodiment.

FIG. 8 is a diagram illustrating a specific example of a screen displayed on the display 1 according to the embodiment.

FIG. 8 illustrates a screen 1SC displayed on the display 1. The screen 1SC displays images 101P and 102P. The image 101P indicates the first display information. Specifically, the image 101P indicates the tray 40 that accommodates blue A4-sized papers, the tray 40 that accommodates white A4-sized papers, the tray 40 that accommodates yellow A4-sized papers, and the tray 40 that accommodates red A4-sized papers at the tray that accommodates sheets of the color which can be selected by the user. Furthermore, the image 101P indicates that the user has selected the tray 40 that accommodates blue A4-sized papers. The fact that the user has selected the tray 40 that accommodates blue A4-sized paper indicates that the user has input the sheet property information indicating accommodation of blue A4-sized paper to the image forming apparatus 100.

The image 102P indicates the second display information or the third display information. Specifically, the image 102P indicates a black toner, a white toner, a gold toner and a red toner as toners selectable by the user when a sheet of blue color is selected. Also, when a sheet of blue color is selected, the image 102P indicates that the user cannot select printing with a blue toner.

Figure 9:
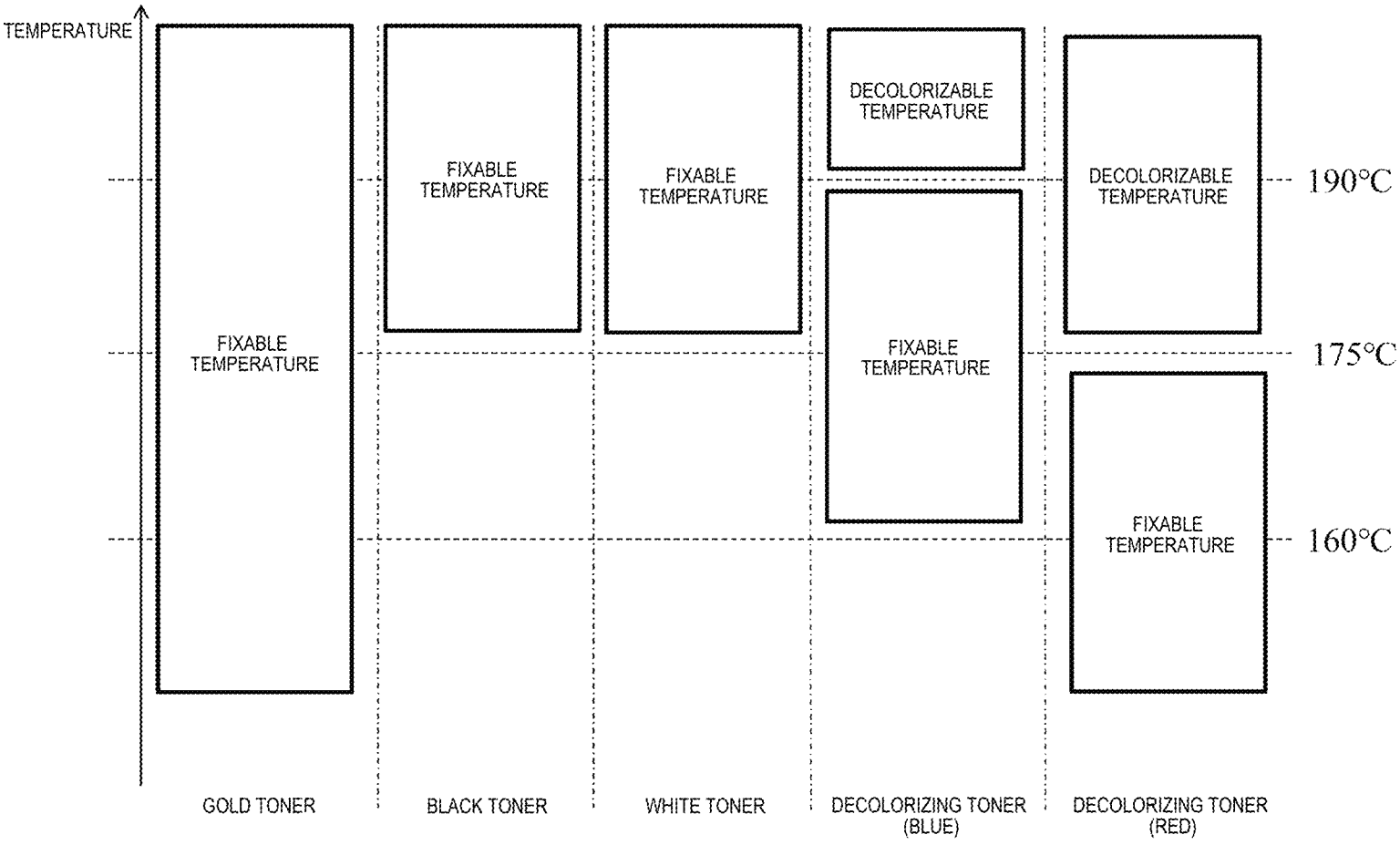
FIG. 9 is a diagram for describing combinations of toners indicated by toner combination information according to the embodiment.

FIG. 9 is a diagram for describing combinations of toners indicated by the toner combination information according to the embodiment.

FIG. 9 illustrates relationships between fixing temperatures and decolorizing temperatures of a gold toner, a black toner, a white toner, a blue color decolorizing toner and a red color decolorizing toner. The fixing temperature of the gold toner is 160° C. or lower. The fixing temperature of the black toner is 175° C. or higher and 190° C. or lower. The fixing temperature of the white toner is 175° C. or higher and 190° C. or lower. The decolorizing temperature of the blue decolorizing toner is 190° C. or higher, and the fixing temperature thereof is 160° C. or higher and 175° C. or lower. The decolorizing temperature of the red decolorizing toner is 175° C. or higher and 190° C. or lower, and the fixing temperature thereof is 160° C. or lower.

As described above, since the fixing temperatures and the decolorizing temperatures are different for each toner, there may be a toner that is decolorized at a temperature at which a certain toner is fixed. In such a case, the color of a part of an image disappears, and thus the reproducibility of the image indicated by the image information is deteriorated. Therefore, the toner combination information does not illustrate a combination of toners in which the fixing temperature of one toner does not overlap the fixing temperature of the other toner.

In FIG. 9, for example, a combination of the black toner and the red color decolorizing toner is information not indicated by the toner combination information. In other words, the combination of the black toner and the red color decolorizing toner is a combination that one toner and the other toner are not fixed simultaneously.

The image forming apparatus 100 configured as described above includes the control unit 20 that causes to display a screen according to input toner property information or sheet property information. Therefore, such the image forming apparatus 100 reduces an increase of the burden of the user for considering a combination of a toner with a sheet.

Also, the image forming apparatus 100 configured as described above includes the control unit 20 that causes to display a screen according to input toner property information or sheet property information. Therefore, such the image forming apparatus 100 reduces an increase of the burden of the user for considering a combination of a toner with a toner.

Also, the image forming apparatus 100 configured as described above includes the control unit 20 that causes to display a screen according to input toner property information or sheet property information. Therefore, such the image forming apparatus 100 reduces an increase of the burden of the user for considering a combination of one toner or a plurality of toners with a sheet.

(Modified Example)

In the sheet presence determination, the control unit 20 does not necessarily determine whether a sheet determined by the determination is accommodated in the tray 40. In the sheet presence determination, the control unit 20 may determine whether the number of sheets accommodated in the tray 40 determined by the determination is equal to or less than a predetermined number.

Also, the toner property information, the sheet property information and the image forming instruction are not necessarily input via the control panel 2. The toner property information, the sheet property information and the image forming instruction maybe input from an external input device via the communication unit 6.

Also, the memory-stored toner property information is not necessarily stored in the toner memory 901 and may be stored in the auxiliary memory device 10. In such a case, information about each toner indicated by the memory-stored toner property information is information associated with a location where the toner cartridge 90 is accommodated in the mounting unit 7. Also, in such a case, the shape of each toner cartridge is unique to each type of toner, and the location where the toner cartridge 90 is accommodated may have a shape corresponding to the unique shape of each toner cartridge.

Furthermore, when the toner cartridge 90 and the mounting unit 7 have the following mechanism (hereinafter referred to as "information output mechanism"), the memory-stored toner property information is not necessarily stored in the toner memory 901. In the information output mechanism, the toner cartridge 90 has a protrusion positioned at a position of the leading end in correspondence to the type of a toner. In the information output mechanism, the mounting unit 7 includes a sensor, which is configured to detect the position of the protrusion at a position where the protrusion touches when the toner cartridge 90 is accommodated. When the toner cartridge and the mounting unit 7 have such a mechanism, the memory-stored toner property information may be information stored in the auxiliary memory device 10 and information indicating information about a toner corresponding to the position of the protrusion.

Also, the toner property information does not necessarily indicate the property of only one toner, but may indicate the properties of a plurality of toners.

In addition, in FIG. 7, the processes of ACT 112 and ACT 114 are not necessarily executed. In this case, the process of ACT 113 may be executed after the process of ACT 111.

All or some of functions of the image forming apparatus 100 may be realized by using hardware, such as application specific integrated circuit (ASIC), programmable logic device (PLD) or field programmable gate array (FPGA). The program may be recorded on a computer-readable recording medium. The computer-readable recording medium is, for example, a portable medium, such as a flexible disk, a magneto-optical disk, a ROM and a CD-ROM, or a storage device built in a computer system, such as a hard disk. The program may be transmitted via an electric communication line.

The control panel 2 is an example of an input unit. The sheet property information is an example of sheet information. The toner property information is an example of developing agent information. The input-completed toner property information is an example of developing agent information. The toner combination condition is an example of developing agent combination conditions.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein maybe made without departing from the spirit of the inventions. The accompanying claims and their equivalents are intended to cover such forms or modifications as would fall within the scope and spirit of the invention.

What is claimed is:

1. An image forming apparatus, comprising:

an image forming unit configured to form an image using a plurality of consumables;

an input unit configured to receive an input of information designating the consumables to be used for forming the image; and a control unit configured to selectively display other candidates of the consumables to be used for forming the image based on the designated consumables, wherein when developing agent information designates the developing agent is input to the input unit, the control unit determines, based on a sheet combination condition that is a predetermined condition between the developing agent and the sheet, a sheet satisfying the sheet combination condition with the developing agent indicated by the developing agent information and selectably displays the determined sheet.

2. The apparatus according to claim 1, wherein the consumables include sheet color or developing agent color.

3. The apparatus according to claim 2, wherein the control unit further determines, based on a developing agent combination condition that is a predetermined condition between a plurality of developing agents, a developing agent that satisfies the developing agent combination condition with the developing agent indicated by the developing agent information and selectably displays the determined developing agent.

4. The apparatus according to claim 2, wherein when developing agent information designates the developing agent is input to the input unit, the control unit determines, based on a developing agent combination condition that is a predetermined condition between a plurality of developing agents, a developing agent satisfying the developing agent combination condition with the developing agent indicated by the developing agent information and selectably displays the determined developing agent.

5. The apparatus according to claim 2, wherein when sheet information designates the sheet is input to the input unit, the control unit determines, based on a sheet combination condition that is a predetermined condition between the developing agent and the sheet, a developing agent satisfying the sheet combination condition with the sheet indicated by the sheet information and selectably displays the determined developing agent.

6. The apparatus according to claim 2, wherein when developing agent information designates the developing agent, and sheet information designates the sheet are input to the input unit, the control unit determines, based on a sheet combination condition that is a predetermined condition between the developing agent and the sheet, and a developing agent combination that is a predetermined condition between a plurality of predetermined developing agents, a developing agent that satisfies the sheet combination condition and the developing agent combination condition, and selectably displays the determined developing agent.

7. The apparatus according to claim 3, wherein the developing agent combination condition is a condition that a color difference between colors of the developing agents is a predetermined value or larger.

8. The apparatus according to claim 2, wherein the sheet combination condition is the color difference between the color of the developing agent and the color of the sheet is a predetermined value or larger.

9. An image forming method, comprising:

forming an image by using a plurality of consumables;

receiving an input of information designating the consumables used for forming the image;

selectably displaying other candidates of the consumables to be used for forming the image based on the designated consumables; and when developing agent information designates the developing agent is input to the input unit, determining, based on a sheet combination condition that is a predetermined condition between the developing agent and the sheet, a sheet satisfying the sheet combination condition with the developing agent indicated by the developing agent information and selectably displaying the determined sheet.

10. The method according to claim 9, wherein the consumables include sheet color or developing agent color.

11. The method according to claim 10, further comprising:

determining, based on a developing agent combination condition that is a predetermined condition between a plurality of developing agents, a developing agent that satisfies the developing agent combination condition with the developing agent indicated by the developing agent information and selectably displaying the determined developing agent.

12. The method according to claim 10, further comprising:

when developing agent information designates the developing agent is input to the input unit, determining, based on a developing agent combination condition that is a predetermined condition between a plurality of developing agents, a developing agent satisfying the developing agent combination condition with the developing agent indicated by the developing agent information and selectably displaying the determined developing agent.

13. The method according to claim 10, further comprising:

when sheet information designates the sheet is input to the input unit, determining, based on a sheet combination condition that is a predetermined condition between the developing agent and the sheet, a developing agent satisfying the sheet combination condition with the sheet indicated by the sheet information and selectably displaying the determined developing agent.

14. The method according to claim 10, wherein when developing agent information designates the developing agent, and sheet information designates the sheet are input to the input unit, determining, based on a sheet combination condition that is a predetermined condition between the developing agent and the sheet, and a developing agent combination that is a predetermined condition between a plurality of predetermined developing agents, a developing agent that satisfies the sheet combination condition and the developing agent combination condition, and selectably displaying the determined developing agent.

15. The method according to claim 11, wherein the developing agent combination condition is a condition that a color difference between colors of the developing agents is a predetermined value or larger.

16. The method according to claim 10, wherein the sheet combination condition is the color difference between the color of the developing agent and the color of the sheet is a predetermined value or larger.

17. An image forming apparatus, comprising:

an image forming unit configured to form an image using a plurality of consumables;

an input unit configured to receive an input of information designating the consumables to be used for forming the image; and a control unit configured to selectively display a color of each of the consumables to be used for forming the image with improved contrast amongst the consumables based on the designated consumables, wherein when developing agent information designates the developing agent is input to the input unit, the control unit determines, based on a sheet combination condition that is a predetermined condition between the developing agent and the sheet, a sheet satisfying the sheet combination condition with the developing agent indicated by the developing agent information and selectably displays the determined sheet.

18. The apparatus according to claim 17, wherein the consumables include sheet color or developing agent color.

* * * * *